US009410304B2

(12) United States Patent
Taylor et al.

(10) Patent No.: US 9,410,304 B2
(45) Date of Patent: Aug. 9, 2016

(54) LIFT ASSEMBLY FOR A WORK VEHICLE

(71) Applicant: CNH Industrial America, LLC, New Holland, PA (US)

(72) Inventors: Lance Taylor, Wichita, KS (US); John Moffitt, Wichita, KS (US)

(73) Assignee: CNH Industrial America LLC, New Holland, PA (US)

( * ) Notice: Subject to any disclaimer, the term of this patent is extended or adjusted under 35 U.S.C. 154(b) by 40 days.

(21) Appl. No.: 14/263,049

(22) Filed: Apr. 28, 2014

(65) Prior Publication Data

US 2015/0308072 A1 Oct. 29, 2015

(51) Int. Cl.

| | |
|---|---|
| ***E02F 3/43*** | (2006.01) |
| ***E02F 9/26*** | (2006.01) |
| ***E02F 3/34*** | (2006.01) |
| ***E02F 3/42*** | (2006.01) |

(52) U.S. Cl.

CPC ..... *E02F 3/431* (2013.01); *E02F 3/3405* (2013.01); *E02F 3/3414* (2013.01); *E02F 3/422* (2013.01); *E02F 9/264* (2013.01)

(58) Field of Classification Search

CPC ..... E02F 3/3414; E02F 3/3405; E02F 9/2004; E02F 9/2217; E02F 9/2296; E02F 9/2207; E02F 3/431; E02F 9/2292; E02F 9/24; E02F 3/432; B60G 2200/132; B60G 2202/134; B60G 2200/422; B60G 2202/154; B60G 2204/4605; B60G 2300/32; B60G 2600/02; B60G 17/018

See application file for complete search history.

(56) References Cited

U.S. PATENT DOCUMENTS

| | | | | | |
|---|---|---|---|---|---|
| 4,355,946 | A * | 10/1982 | Wykhuis | E02F 3/3405 | 414/707 |
| 5,192,179 | A | 3/1993 | Kovacs | | |
| 5,470,190 | A * | 11/1995 | Bamford | B60K 20/00 | 414/686 |
| 5,542,814 | A * | 8/1996 | Ashcroft | E02F 3/3405 | 414/685 |
| 5,609,464 | A * | 3/1997 | Moffitt | E02F 3/3405 | 414/685 |
| 6,109,858 | A * | 8/2000 | Deneve | E02F 3/34 | 414/685 |
| 6,132,163 | A * | 10/2000 | Andrews | E02F 3/3405 | 414/685 |
| 6,325,589 | B1 * | 12/2001 | Jang | E02F 3/3405 | 414/685 |
| 6,474,933 | B1 * | 11/2002 | Hoechst | E02F 3/283 | 414/686 |
| 6,616,398 | B2 | 9/2003 | Dershem et al. | | |
| 6,796,762 | B2 * | 9/2004 | Vicars, III | E02F 3/3405 | 414/685 |
| 6,854,951 | B2 | 2/2005 | Mimuro | | |
| 6,866,466 | B2 | 3/2005 | Roan et al. | | |

(Continued)

FOREIGN PATENT DOCUMENTS

EP 2503063 A2 9/2012

*Primary Examiner* — Truc M Do

(74) *Attorney, Agent, or Firm* — Sue C. Watson

(57) ABSTRACT

In one aspect, a lift assembly for a work vehicle may include a loader arm and a control arm extending between first and second ends. The first end may be coupled to a chassis of the vehicle at a first pivot point and the second end may be coupled to a rear end of the loader arm at a second pivot point. Additionally, the lift assembly may include a lift cylinder coupled between the loader arm and the chassis and a control cylinder extending between upper and lower ends, with the upper end being coupled the control arm and the lower end being coupled to the chassis at a third pivot point.

17 Claims, 8 Drawing Sheets

(56) References Cited

U.S. PATENT DOCUMENTS 6,957,705 B2 10/2005 O'Brien et al.
6,997,667 B2 * 2/2006 Hackett ..... B28C 5/4272 414/501
7,128,518 B2 * 10/2006 Yamashita ..... E02F 3/3405 414/686
7,152,709 B2 12/2006 Jung
7,214,026 B2 * 5/2007 Hilvers ..... E02F 9/0833 414/685
7,264,435 B2 * 9/2007 Layko ..... E02F 3/342 414/686
7,507,064 B2 * 3/2009 Shibuya ..... E02F 3/3405 414/685
8,152,433 B2 * 4/2012 Yamada ..... E02F 3/3405 414/680
8,453,785 B2 6/2013 Kisse et al.
8,459,927 B2 6/2013 England et al.
2002/0064445 A1 * 5/2002 Dershem ..... E02F 3/3405 414/686
2004/0145134 A1 * 7/2004 Bares ..... B62D 51/02 280/32.7
2005/0275184 A1 * 12/2005 Lamela ..... B60G 17/0152 280/124.157
2008/0108032 A1 * 5/2008 Tuhy ..... E02F 9/226 434/245
2009/0038186 A1 * 2/2009 Osswald ..... B62D 21/14 37/413
2009/0055057 A1 * 2/2009 Osborn ..... G05B 19/0423 701/50
2009/0162177 A1 * 6/2009 Nichols ..... E02F 3/431 414/698
2009/0178816 A1 * 7/2009 Piekutowski ..... G01C 15/004 172/430
2010/0204891 A1 * 8/2010 Biggerstaff ..... E02F 3/3414 701/50
2011/0027056 A1 * 2/2011 England ..... E02F 3/3414 414/680
2012/0251282 A1 * 10/2012 Selvarajpandian ... E02F 9/2271 414/680
2013/0238178 A1 * 9/2013 Young ..... B60W 10/06 701/22
2014/0263607 A1 * 9/2014 Mindeman ..... G06F 17/30 235/375

* cited by examiner

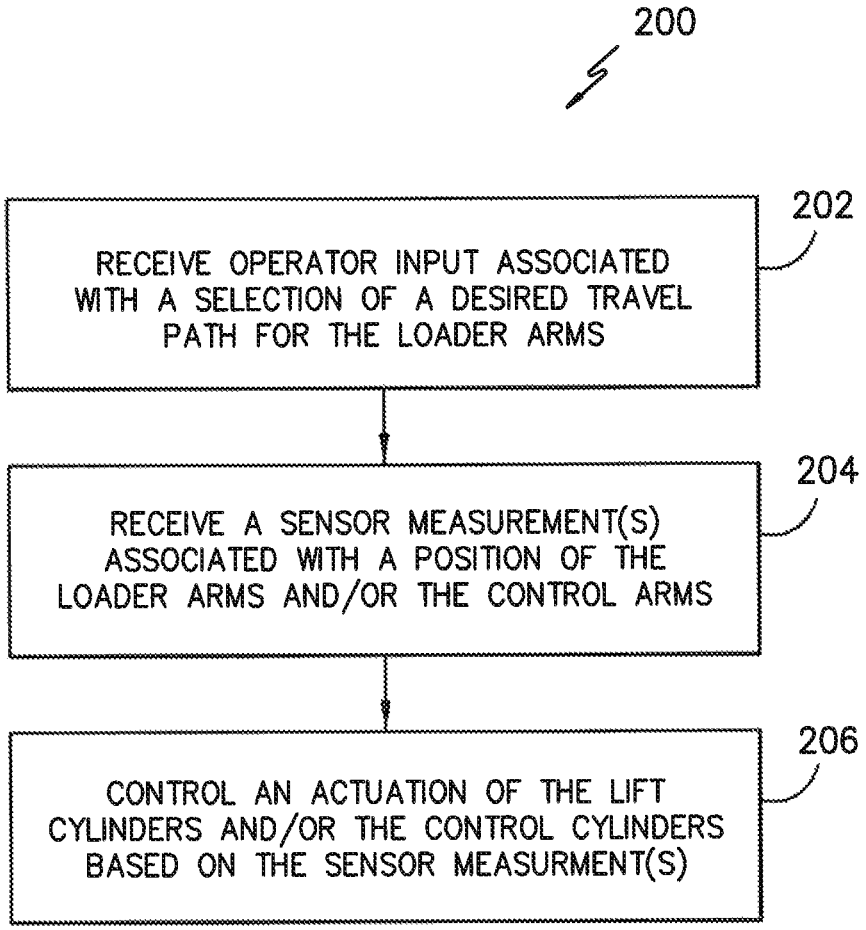
*FIG. —8—*

LIFT ASSEMBLY FOR A WORK VEHICLE

FIELD OF THE INVENTION

The present subject matter relates generally to work vehicles and, more particularly, to an improved lift assembly that allows for the loader arms of a work vehicle to be raised and/or lowered along a plurality of different travel paths.

BACKGROUND OF THE INVENTION

Work vehicles having loader arms, such as skid steer loaders, telescopic handlers, wheel loaders, backhoe loaders, forklifts, compact track loaders and the like, are a mainstay of construction work and industry. For example, skid steer loaders typically include a pair of loader arms pivotally coupled to the vehicle's chassis that can be raised and lowered at the operator's command. The loader arms typically have an implement attached to their end, thereby allowing the implement to be moved relative to the ground as the loader arms are raised and lowered. For example, a bucket is often coupled to the loader arm, which allows the skid steer loader to be used to carry supplies or particulate matter, such as gravel, sand, or dirt, around a worksite.

Typically, each lift arm is coupled to the loader chassis at a given pivot point and is configured to be raised and lowered by a corresponding lift cylinder. As such, when the lift cylinders are extended and retracted, the loader arms may be raised and lowered, respectively, along a radial or arced path centered at the pivot point defined between the loader arms and the chassis. Such a radial lift path is often adequate for many loader applications but may not be the most desirable in applications where there is a need to alter the lift path of the loader arms to optimize performance for various tasks. For instance, to increase the rated operating capacity of the loader, it is desirable to have a substantially vertical lift path for the loader arms. As a result, manufacturers currently provide loader configurations that include complex four-bar linkages for the loader arms that allow for a substantially vertical lift path to be achieved. However, these loader configurations are restricted to lifting the loader arms along their single, pre-defined vertical lift path and, thus, the ability to alter the lift path of the loader arms for various tasks is lost.

Accordingly, an improved lift assembly for a work vehicle that allows for the loader arms of such vehicle to be raised and/or lowered along a plurality of different travel paths to allow for variations in the rated operating capacity, horizontal reach and/or cycle times associated with the loader arms would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a lift assembly for a work vehicle. The lift assembly may generally include a loader arm extending between a forward end and a rear end and a control arm extending between a first end and a second end. The first end may be coupled to a chassis of the work vehicle at a first pivot point and the second end may be coupled to the rear end of the loader arm at a second pivot point. In addition, the lift assembly may include a lift cylinder coupled between the loader arm and the chassis and a control cylinder extending between an upper end and a lower end, with the upper end being coupled to the control arm and the lower end being coupled to the chassis at a third pivot point. Moreover, the first pivot point may be located rearward of the second pivot point when the control cylinder is at a fully retracted position.

In another aspect, the present subject matter is directed to a lift assembly for a work vehicle. The lift assembly may generally include a loader arm extending between a forward end and a rear end and a control arm extending between a first end and a second end. The first end may be coupled to a chassis of the work vehicle at a first pivot point and the second end may be coupled to the rear end of the loader arm at a second pivot point. In addition, the lift assembly may include a lift cylinder coupled between the loader arm and the chassis and a control cylinder extending between an upper end and a lower end, with the upper end being coupled to the control arm and the lower end being coupled to the chassis at a third pivot point. Moreover, the lift cylinder may be coupled to the chassis at a fourth pivot point that is positioned both vertically below and rearward of the third pivot point.

In a further aspect, the present subject matter is directed to a method for controlling a lift assembly of a work vehicle. The lift assembly may include a loader arm and a control arm, wherein the control arm extends between a first end coupled to a chassis of the work vehicle at a first pivot point and a second end coupled to the loader arm at a second pivot point. The method may generally include receiving an operator input associated with a selection of a desired travel path for the loader arm, receiving at least one sensor measurement associated with a position of at least one of the loader arm or the control arm and controlling an actuation of at least one of a lift cylinder or a control cylinder of the lift assembly based on the at least one sensor measurement such that a reference point defined on the loader arm is raised or lowered along the desired travel path, wherein the lift cylinder is coupled between the loader arm and the chassis and wherein the control cylinder extends between an upper end coupled to the control arm and a lower end coupled to the chassis at a third pivot point.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 8 illustrates a flow diagram of one embodiment of a method for controlling a lift assembly of a work vehicle in accordance with aspects of the present subject matter.

DETAILED DESCRIPTION OF THE INVENTION

Figure 1:
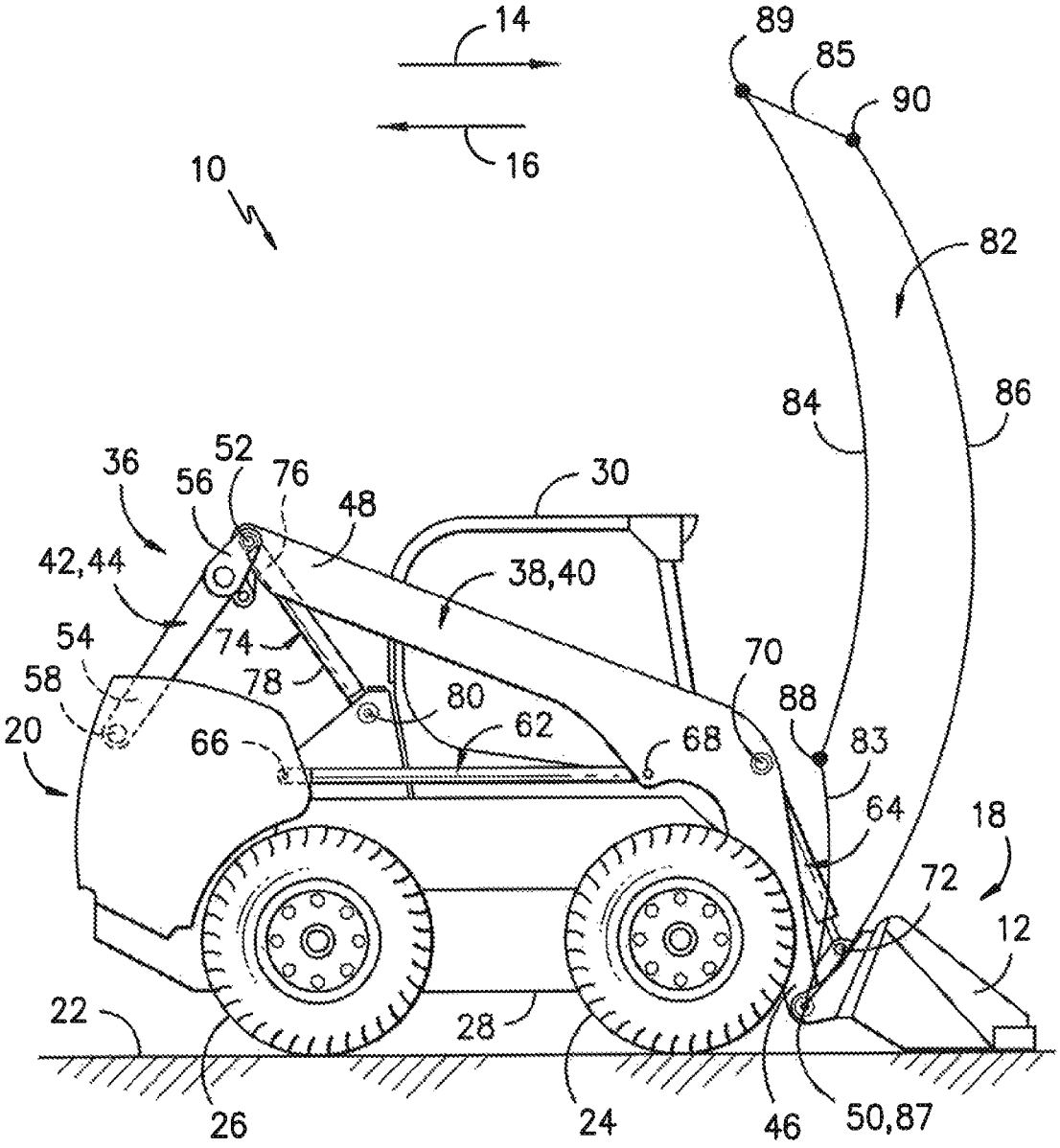
FIG. 1 illustrates a side view of one embodiment of a work vehicle in accordance with aspects of the present subject matter, particularly illustrating an implement of the work vehicle being located at its lowermost position relative to a driving surface of the vehicle.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to an improved lift assembly for a work vehicle. Specifically, in several embodiments, the lift assembly may include a pair of loader arms pivotally coupled to a corresponding pair of control arms, with each control arm being pivotally coupled, in turn, to the chassis of the work vehicle. In addition, the lift assembly may include a pair of lift cylinders for raising and lowering the loader arms and a pair of control cylinders for adjusting the position of a dynamic pivot point defined between the control arms and the loader arms. Specifically, by retracting and/or extending the control cylinders, the control arms may be pivoted about a fixed pivot point defined between the control arms and the chassis, thereby adjusting the relative position of the dynamic pivot point.

Such adjustments of the dynamic pivot point may allow for the travel path of the loader arms to be varied as the arms are raised and/or lowered relative to the ground via the lift cylinders. Thus, by carefully controlling the actuation of the control cylinders and the lift cylinders, the loader arms may be raised and/or lowered along a plurality of different travel paths, thereby allowing specific travel paths to be selected and/or tailored to the requirements of the work being performed. For instance, if increased lift capacity is required, the actuation of the control cylinders and the lift cylinders may be controlled in a manner that provides for the forward end of the loader arms (i.e., the end coupled to a suitable implement, such as a bucket) to be raised and/or lowered along a substantially vertical travel path. Alternatively, if increased reach and/or increased lift speed is required, the actuation of the control cylinders and lift cylinders may be controlled in a manner that provides for the forward end of the loader arms to be raised and/or lowered along a more radial or arcuate travel path. Moreover, the use of the control cylinders may also allow for the forward end of the loader arms to be raised and/or lowered along an absolute straight vertical travel path along at least a portion of the vertical distance defined between the vehicle's driving surface and the maximum lift height for the loader arms.

Figure 2:
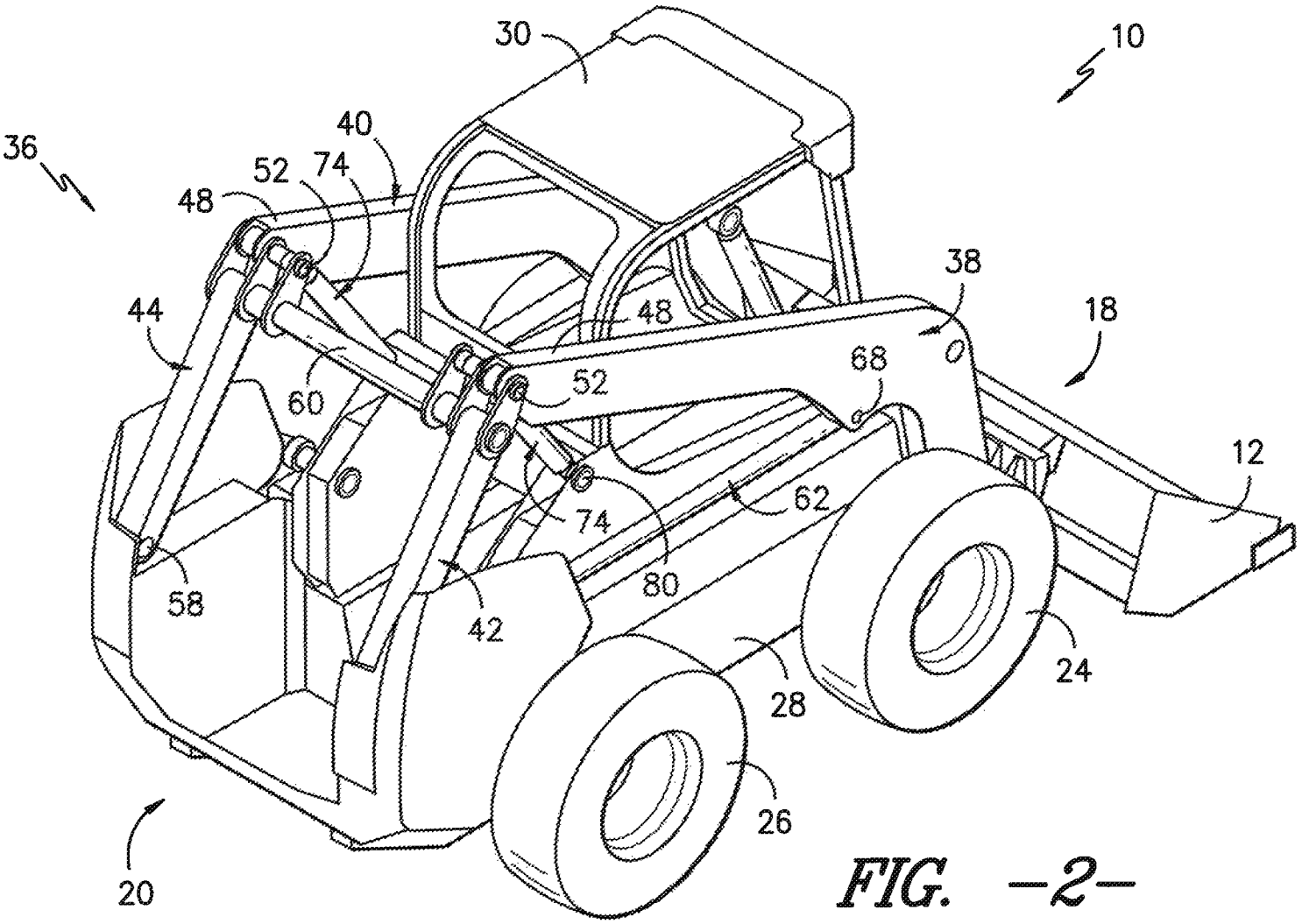
FIG. 2 illustrates a rear perspective view of the work vehicle shown in FIG. 1.
Figure 3:
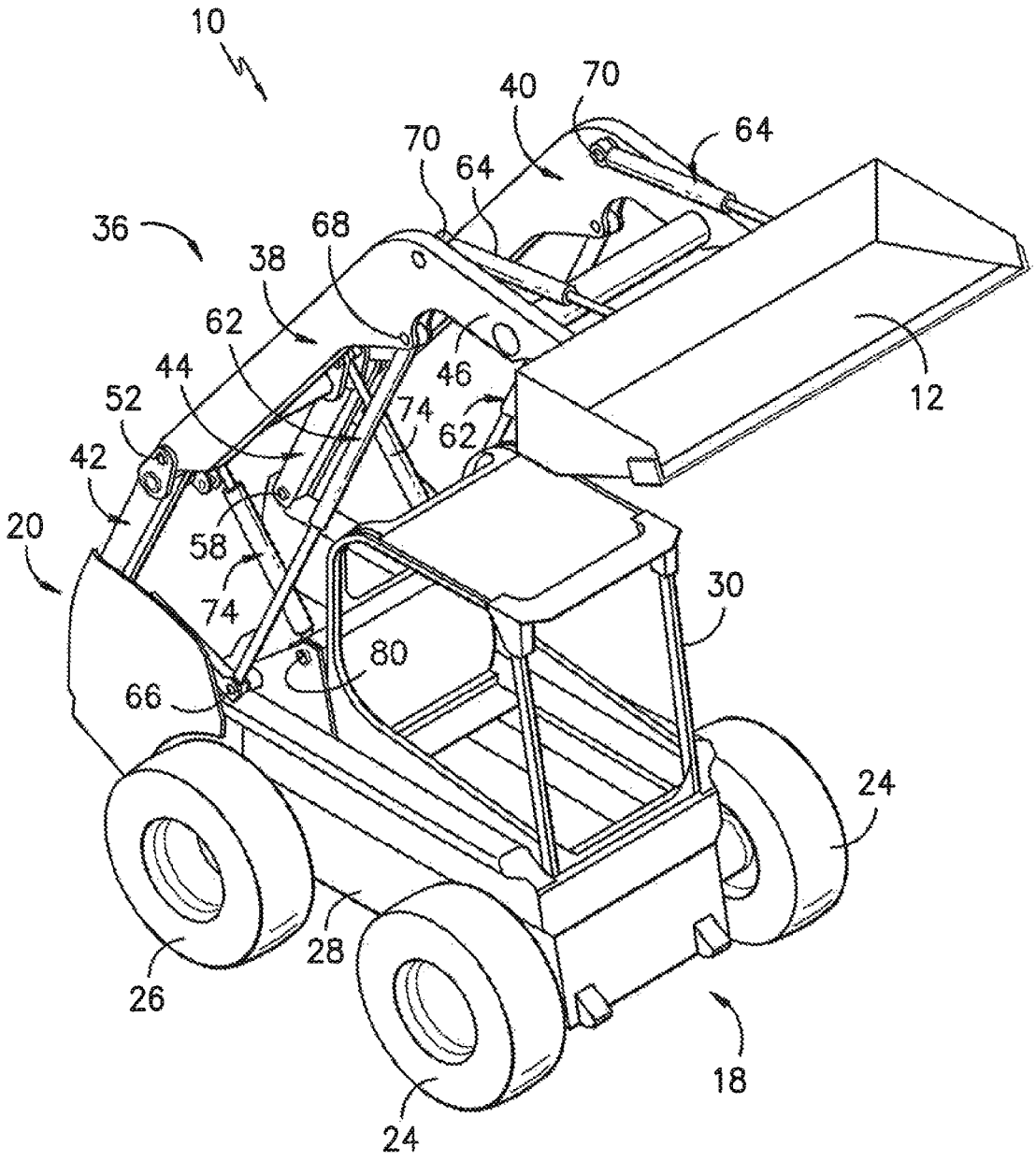
FIG. 3 illustrates a front perspective view of the work vehicle shown in FIG. 1, particularly illustrating the implement after it has been raised from its lowermost position via a lift assembly of the vehicle.

Referring now to FIGS. 1-3, one embodiment of a work vehicle 10 is illustrated in accordance with aspects of the present subject matter. Specifically, FIG. 1 illustrates a side view of the work vehicle 10, particularly illustrating an implement 12 of the work vehicle 10 being located at its lowermost position relative to a driving surface 22 of the vehicle 10. Additionally, FIG. 2 illustrates a rear perspective view of the work vehicle 10 shown in FIG. 1 and FIG. 3 illustrates a front perspective of the work vehicle 10 after the implement 12 has been raised from its lowermost position. For purposes of description, the forward direction (indicated by arrow 14 in FIG. 1) and the reverse direction (indicated by arrow 16 in FIG. 1) will be referenced relative to a front end 18 and a rear end 20 of the work vehicle 10. Thus, for example, a first location on the work vehicle 10 may be considered to be positioned rearward of a second location on the work vehicle 10 if the first location is positioned closer to the rear end 20 of the work vehicle 10 than the second location along a reference plane extending parallel to the driving surface 22.

In the illustrated embodiment, the work vehicle 10 is configured as a skid steer loader. However, in other embodiments, the work vehicle 10 may be configured as any other suitable work vehicle known in the art, such as any other work vehicle including loader arms (e.g., telescopic handlers, wheel loaders, backhoe loaders, forklifts, compact track loaders and/or the like).

As shown, the work vehicle 10 includes a pair of front wheels 24, a pair of rear wheels 26 and a chassis 28 coupled to and supported by the wheels 24, 26. An operator's cab 30 may be supported by a portion of the chassis 28 and may house various input devices for permitting an operator to control the operation of the work vehicle 10. In addition, the work vehicle 10 may include an engine (not shown) and a hydrostatic drive unit (not shown) coupled to or otherwise supported by the chassis 28.

It should be appreciated that various components of the work vehicle 10 will be described herein as being coupled to the chassis 28. As used herein, a component may be "coupled to" the chassis 28 by being directly coupled to a component of the chassis 28 or by being indirectly coupled to a component of the chassis 28 (e.g., via a secondary component).

Moreover, as shown in FIGS. 1-3, the work vehicle 10 may also include a lift assembly 36 for raising and lowering the implement 12 (e.g., a bucket, fork, blade and/or the like) relative to the driving surface 22 of the vehicle 10. In several embodiments, the lift assembly 36 may include a pair of loader arms (e.g., a first loader arm 38 and a second loader arm 40) pivotally coupled to the implement 12 and a corresponding pair of control arms (e.g., a first control arm 42 and a second control arm 44) pivotally coupled between the loader arms 38, 40 and the chassis 28. Specifically, as shown in FIG. 1, the loader arms 38, 40 may each be configured to extend lengthwise between a forward end 46 and an aft end 48, with the forward end 46 of each loader arm 38, 40 being pivotally coupled to the implement 12 at a forward pivot point 50 and the aft end 48 of each loader arm 38, 40 being pivotally coupled to its corresponding control arm 42, 44 at a dynamic rear pivot point 52. Similarly, each control arm 42, 44 may extend between a first end 54 and a second end 56, with the first end 54 being pivotally coupled to the chassis 28 at a fixed pivot point 58 and the second end 56 being pivotally coupled to the aft end 48 of the corresponding loader arm 38, 40 at the dynamic pivot point 52.

As particularly shown in FIG. 2, in several embodiments, a connector arm 60 may be configured to extend perpendicularly between the control arms 42, 44 in order to secure the control arms 42, 44 to one another. For example, in one embodiment, the connector arm 60 may have a tube-like configuration and may be configured to be inserted through corresponding openings (not shown) defined in the control arms 42, 44. In such an embodiment, the connector arm 60 may be secured within the openings (e.g., by welding the portions of the connector arm 60 extending through the openings to the control arms 44, 44) in order to form a frame assembly comprised of the control arms 42, 44 and the connector arm 60. By securing the control arms 42, 44 together via the connector arm 60, it can be ensured that the control arms 42, 44 are pivoted simultaneously about the fixed pivot point 58 as the loader arms 38, 40 are being raised and/or lowered.

In addition, the lift assembly 36 may also include a pair of hydraulic lift cylinders 62 coupled between the chassis 28 and the loader arms 38, 40 and a pair of hydraulic tilt cylinders 64 coupled between the loader arms 38, 40 and the implement 12. For example, as shown in the illustrated embodiment, each lift cylinder 62 may be pivotally coupled to the chassis at a lift pivot point 66 and may extend outwardly therefrom so to be coupled to its corresponding loader arm 38, 40 at an intermediate attachment location 68 defined between the forward and aft ends 46, 48 of each loader arm 38, 40. Similarly, each tilt cylinder 68 may be coupled to its corresponding loader arm 38, 40 at a first attachment location 70 and may extend outwardly therefrom so as to be coupled to the implement 12 at a second attachment location 72.

It should be readily understood by those of ordinary skill in the art that lift and tilt cylinders 62, 64 may be utilized to allow the implement 12 to be raised/lowered and/or pivoted relative to the driving surface 22 of the work vehicle 10. For example, the lift cylinders 62 may be extended and retracted in order to pivot the loader arms 38, 40 upward and downwards, respectively, about the dynamic pivot point 52, thereby at least partially controlling the vertical positioning of the implement 12 relative to the driving surface 22. Similarly, the tilt cylinders 64 may be extended and retracted in order to pivot the implement 12 relative to the loader arms 38, 40 about the forward pivot point 50, thereby controlling the tilt angle or orientation of the implement 12 relative to the driving surface 22.

Moreover, in several embodiments, the lift assembly 36 may also include a pair of control cylinders 74 for adjusting the relative location of the dynamic pivot point 52, thereby allowing for the travel path of the loader arms 38, 40 to be dynamically adjusted as the implement 12 is being raised and/or lowered relative to the drive surface 22. Specifically, as shown in the illustrated embodiment, the control cylinders 74 may each be configured to extend between a top end 76 and a bottom end 78, with the top end 76 of each control cylinder 74 being pivotally coupled to its corresponding control arm 42, 44 at the dynamic pivot point 52 and the bottom end 78 being pivotally coupled to the vehicle's chassis 28 at a control pivot point 80. Alternatively, the top end 76 of each control cylinder 74 may be coupled to the corresponding control arm 42, 44 at any other suitable location along the arm's length, such as at a location between the dynamic pivot point 52 and the fixed pivot point 58. Regardless, the control cylinders 74 may be extended and retracted in order to adjust the location of the dynamic pivot point 52 in a counter-clockwise direction or a clockwise direction, respectively, about the fixed pivot point 58. Thus, by controlling the actuation or stroke length of the control cylinders 74, the loader arms 38, 40 may be raised and/or lowered along any number of different travel paths as the lift cylinders 62 as are used to adjust the position of the implement 12 relative to the driving surface 22.

For example, FIG. 1 illustrates a bounded travel area 82 defining the potential area across which the forward pivot point 50 may be moved using the disclosed lift assembly 36. Specifically, as shown in FIG. 1, the travel area 82 is defined by a first boundary line 83, a second boundary line 84, a third boundary line 85 and a fourth boundary line 86. The first and third boundary lines 83, 85 generally define the range of movement for the loader arms 38, 40 at the forward pivot point 50 when the control cylinders 74 are being actuated while the lift cylinders 62 are maintained at either their fully retracted position or their fully extended position. For example, when the forward pivot point 50 is located at the lowermost position within the bounded travel area 82 (i.e., at point 87), the forward pivot point 50 may be moved along the first boundary line 83 to point 88 by simply actuating the control cylinders 74 from a fully retracted position (at point 87) to a fully extended position (at point 88) while maintaining the lift cylinders 62 at their fully retracted position. Similarly, the forward pivot point 50 may be moved along the third boundary line 85 from point 89 to point 90 by simply actuating the control cylinders 74 from a fully extended position (at point 89) to a fully retracted position (at point 90) while maintaining the lift cylinders 62 at their fully extended position.

Moreover, the second and fourth boundary lines 84, 86 generally define the range of movement for the loader arms 38, 40 at the forward pivot point 50 when the lift cylinders 62 are being actuated while the control cylinders 74 are maintained in either their fully extended position or their fully retracted position. For example, to move the forward pivot point 50 from point 88 to point 89, the lift cylinders 62 may be actuated from a fully retracted position (at point 88) to a fully extended position (at point 89) while maintaining the control cylinders 74 at their fully extended position. Similarly, to move the forward pivot point 50 from point 87 to point 90, the lift cylinders 62 may be actuated from a fully retracted position (at point 87) to a fully extended position (at point 90) while maintaining the control cylinders 74 at their fully retracted position. As such, it should be readily understood that, to move the forward pivot point 50 from the lowermost position defined within the bounded travel area 82 (i.e., at point 87) to any other location on or within such area 82, each control cylinder 74 may be either initially maintained at its fully retracted position (e.g., to raise the forward pivot point 50 along the fourth boundary line 86) or initially extended outwardly from its fully retracted position (e.g., to initially move the forward pivot point 50 to any location rearward of the fourth boundary line 86).

It should be appreciated that, in several embodiments, the positioning of the control arms 42, 44 relative to the loader arms 38, 40 and/or the relative positioning of the various pivot points 52, 58, 66, 80 may be selected such that the desired travel area 82 is defined for the loader arms 38, 40 at the forward pivot point 50. For example, as shown in the illustrated embodiment, the location of the fixed pivot point 58 may be selected such that the pivot point 58 is positioned rearward of and vertically below the dynamic pivot point 52 when the control cylinders 74 are at their fully retracted positions. As such, each control arm 42, 44 may be configured to be angled both forward and upward from its first end 54 to its second end 56 when the control cylinders 74 are at their fully retracted positions. Additionally, in one embodiment, the location of the fixed pivot point 58 may be selected such that the pivot point 58 is still positioned rearward of the dynamic pivot point 52 even when the control cylinders 74 are at their fully extended positions. Moreover, in several embodiments, the location of the control pivot point 80 for each control cylinder 74 may be selected such that the pivot point 80 is located both vertically above and forward of the lift pivot point 66 for each lift cylinder 62. However, it should be appreciated that, in alternative embodiments, the positioning of the control arms 42, 44 relative to the loader arms 38, 40 and/or the relative positioning of the various pivot points 52, 58, 66, 80 may be adjusted to provide any other suitable configuration that allows for the loader arms 38, 40 to be raised and/or lowered along a plurality of different travel paths in a manner consistent with the disclosure provided herein.

Figure 4:
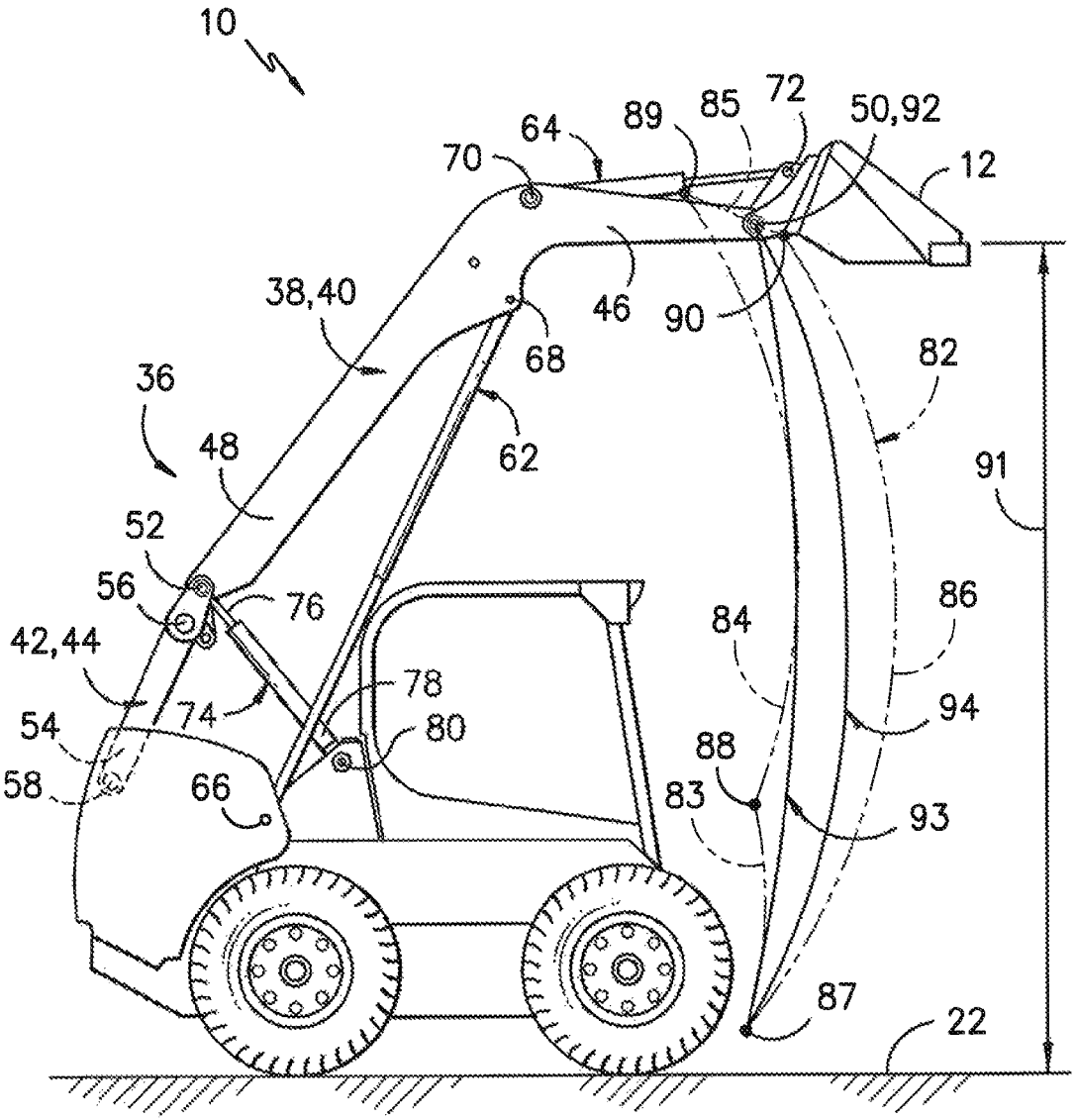
FIG. 4 illustrates a side view of the work vehicle shown in FIG. 1 with the implement being raised relative to the vehicle's driving surface to a first location, particularly illustrating two suitable travel paths that may be used to raise the implement to the first location in accordance with aspects of the present subject matter.

Moreover, given the bounded travel area 82 shown in FIG. 1, one of ordinary skill in the art should readily appreciate that any number of different travel paths may be achieved within such area 82 by selectively actuating the lift cylinders 62 and the control cylinders 74 as the loader arms 38, 40 are being raised and/or lowered relative to the driving surface 22. For example, as shown in FIG. 4, it may be desirable for the implement 12 to be raised to a given height 91 above the vehicle's driving surface 22 (e.g., such that the forward pivot point 50 is located at point 92). In such instance, the loader arms 38, 40 may be directed along various different travel paths as the forward pivot point 50 is moved between point 87 and point 92. For example, as shown in FIG. 4, a substantially vertical travel path 93 may be defined between the points 87 and 92, which may allow for the work vehicle 10 to have an increased lift capacity. Alternatively, a more radial or arced travel path 94 may be defined between the points 87 and 92, which may allow for the implement 12 to be raised to the desired height 91 in a shorter amount of time than that required for the substantially vertical travel path 93.

Figure 5:
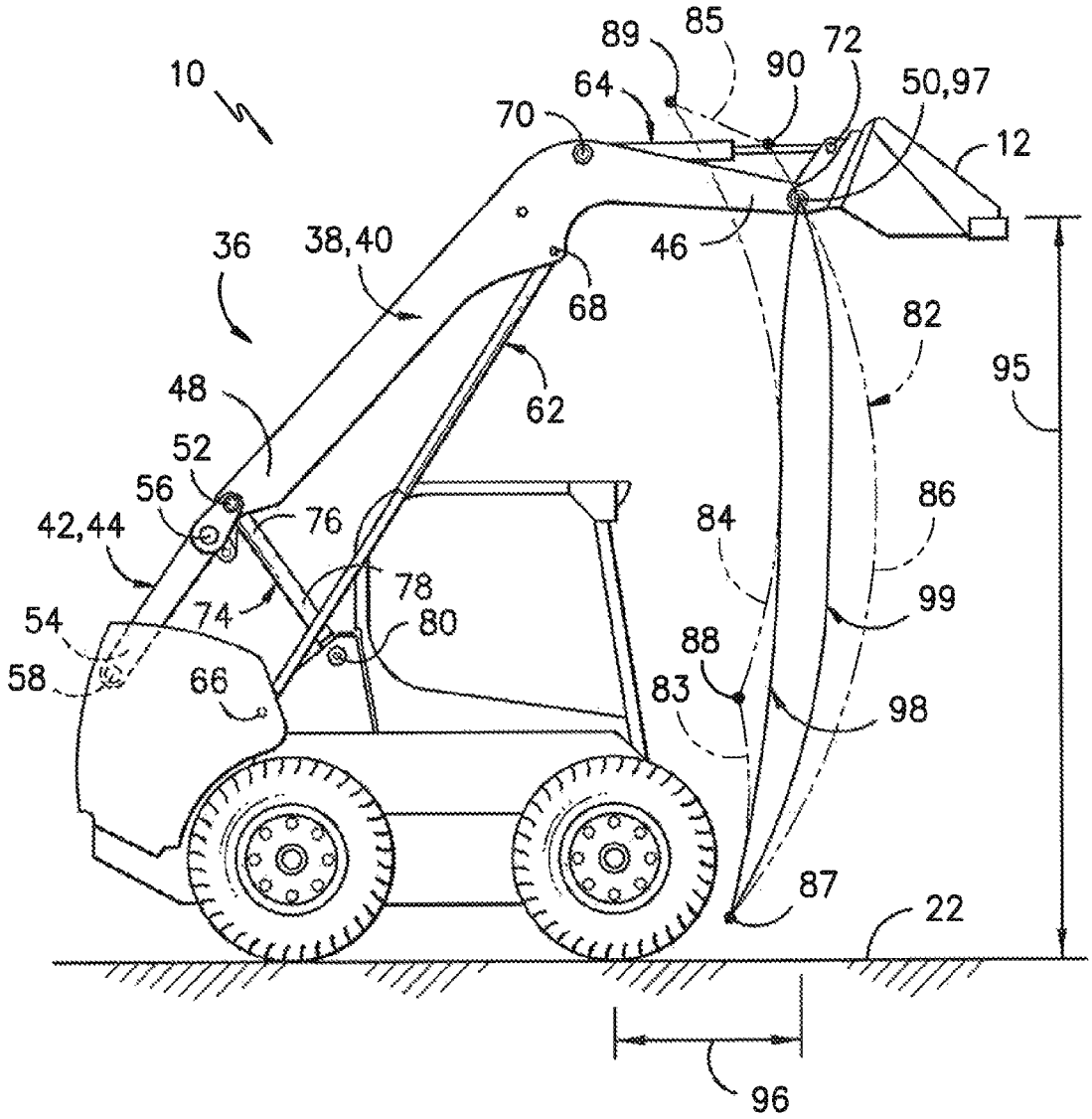
FIG. 5 illustrates another side view of the work vehicle shown in FIG. 1 with the implement being raised relative to the vehicle's driving surface to a second location, particularly illustrating two suitable travel paths that may be used to raise the implement to the second location in accordance with aspects of the present subject matter.

Another example of suitable travels paths that may be provided within the bounded travel area 82 is shown in FIG. 5. As shown, it may be desirable for the implement 12 to be raised to a certain vertical height 95 while also being capable of extending outwardly a given horizontal distance 96 in order to increase the overall reach of the implement 12 (e.g., to point 97). In such instance, similar to the example described above with reference to FIG. 4, various different travel paths may be defined between point 87 and point 97. For instance, as shown, a substantially vertical travel path 98 may defined between the points 87 and 97, which may allow for increased lift capacity. Alternatively, a more radial or arced travel path 88 may be defined between points 87 and 97, which may allow for the loader arms 38, 40 to be raised and/or lowered in less time.

It should be appreciated that the various travel paths 93, 94, 98, 99 shown in FIGS. 4 and 5 are simply illustrated to provide several examples of suitable travel paths that may be achieved using the disclosed lift assembly 36. However, one of ordinary skill in the art should readily understand that any number of different travel paths may be defined within the bounded travel area 82 by altering the manner in which the control cylinders 74 and the lift cylinders 62 are actuated as the implement 12 is being raised and/or lowered relative to the driving surface 22. In addition, it should be appreciated that, as an alternative to the forward pivot point 50, the bounded travel area 82 for the loader arms 38, 40 may be defined relative to any other suitable reference point or location along each loader arm 38, 40.

Figure 6:
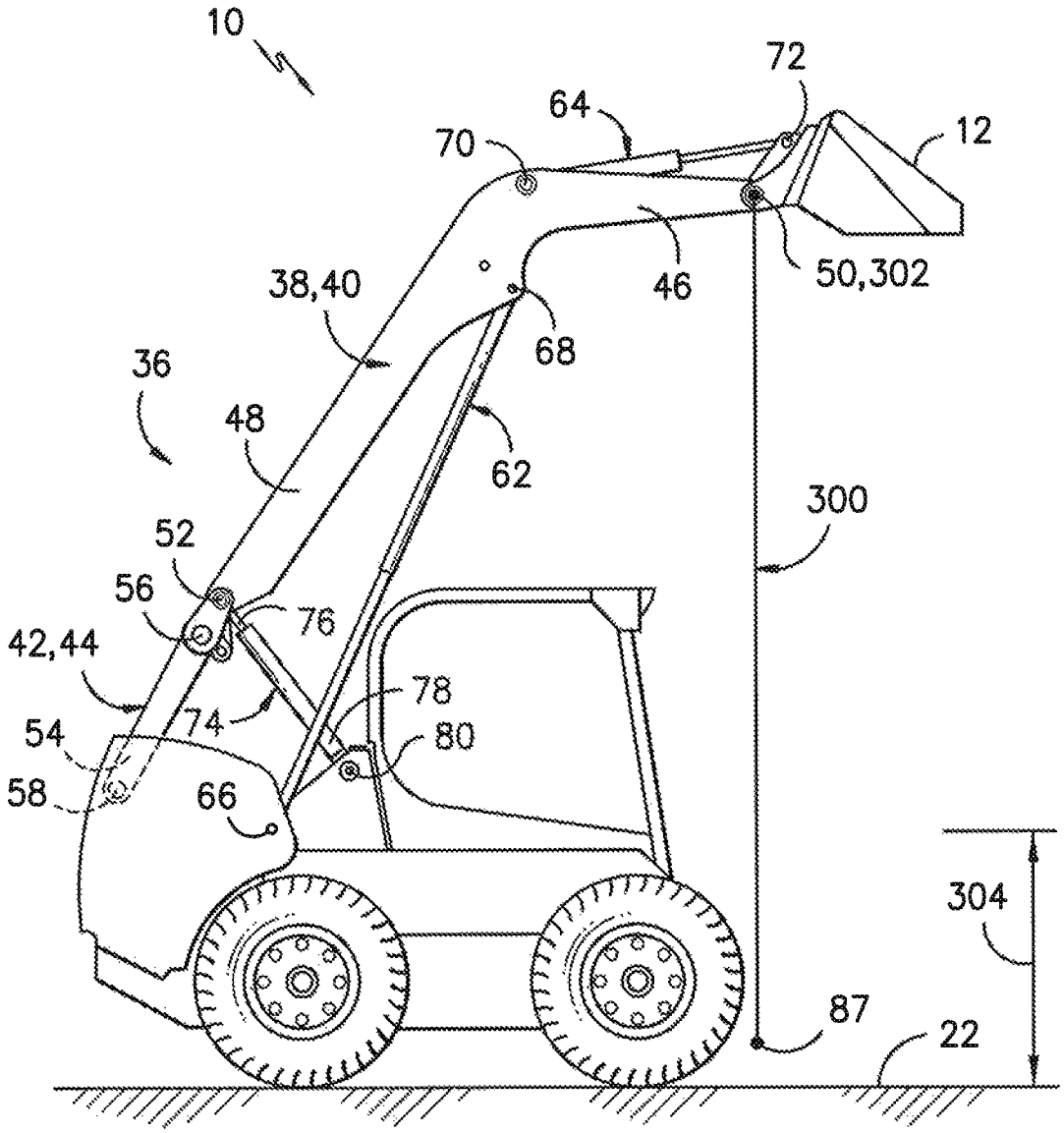
FIG. 6 illustrates a further side view of the work vehicle shown in FIG. 1, particularly illustrating one example of a straight vertical travel path along which the loader arms may be raised and lowered in accordance with aspects of the present subject matter.

It should also be appreciated that, by adjusting one or more parameters associated with the lift cylinders 62 and/or the control cylinders 74 and/or by adjusting the relative positioning of the various pivot points 52, 58, 66, 80, the shape and/or size of bounded travel area 82 may be varied significantly. For instance, in a particular embodiment, the bounded travel area 82 may be expanded or shifted rearward such that the forward pivot point 50 may be moved along an absolute straight vertical travel path from the lowermost position 87. An example of such a lift path is illustrated in FIG. 6. As shown, the control cylinders 74 and the lift cylinders 62 may be controlled in a manner that allows the forward pivot point to be raised and lowered along a vertically straight path 300 extending between point 87 and point 302. To achieve this vertical path 300, the lift cylinders 62 may, in one embodiment, by configured such that each cylinder 62 is not in its fully retracted position when the forward pivot point 50 is located at the lowermost position 87 (i.e., such that the lift cylinders 62 may be further retracted at point 87). Such a configuration may generally allow for the aft boundary of the bounded travel area (e.g., defined by the first and second boundary lines 83, 84 shown in FIGS. 4 and 5) to be shifted rearward, thereby accommodating the vertical travel path 300 shown in FIG. 6. In such an embodiment, to begin raising the forward pivot point 50 upward from point 87 along the vertical path 300, the lift cylinders 62 may be initially retracted towards their fully retracted position while the control cylinders 74 are extended until the forward pivot point 50 has reached a given height 304. Thereafter, the lift cylinders 62 may be extended as the control cylinders 74 are controlled in a manner that allows the forward pivot point 50 to be lifted along the remainder of the vertical path 300.

Additionally, it should be appreciated that, although the work vehicle 10 shown in FIGS. 1-6 has been described herein as including a pair of control cylinders 74 and a pair of lift cylinders 62, the work vehicle 10 may, instead, include any number of control cylinders 74 and lift cylinders 62. For instance, in one embodiment, the work vehicle 10 may only include a single control cylinder 74 and a single lift cylinder 62 for controlling the movement of the loader arms 38, 40. Alternatively, the work vehicle 10 may include a single control cylinder 74 together with a pair of lift cylinders 62 for controlling the movement of the loader arms 38, 40 or vice versa.

Figure 7:
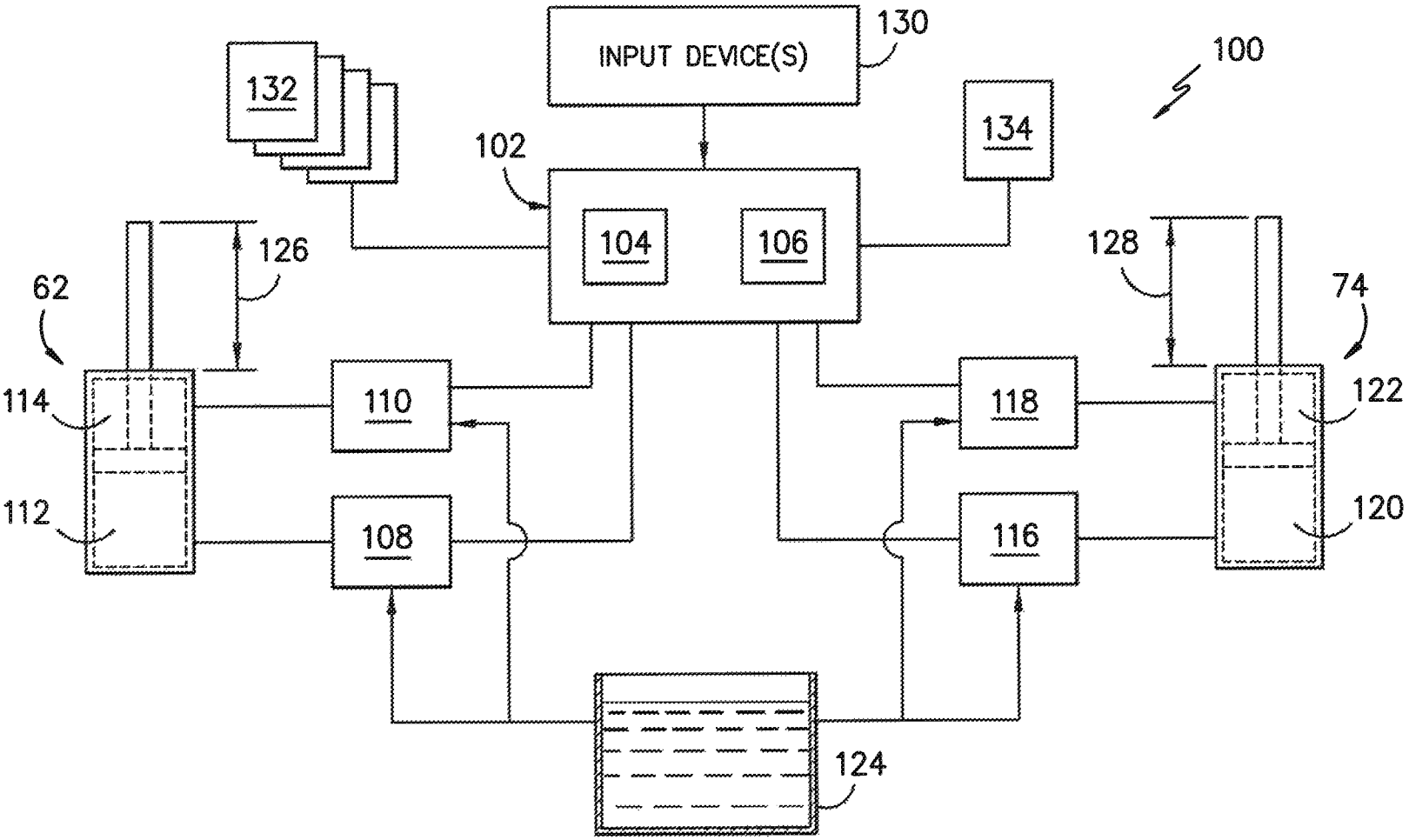
FIG. 7 illustrates a schematic diagram of one embodiment of a control system for controlling a lift assembly of a work vehicle in accordance with aspects of the present subject matter.

Referring now to FIG. 7, a schematic diagram of one embodiment of a control system 100 for controlling the disclosed lift assembly 36 is illustrated in accordance with aspects of the present subject matter. In general, the system 100 will be described herein with reference to the work vehicle 10 and lift assembly 36 described above with reference to FIGS. 1-6. However, it should be appreciated by those of ordinary skill in the art that the disclosed system 100 may generally be utilized with work vehicles 10 having any another suitable vehicle configuration and/or any other suitable lift assembly configuration consistent with the disclosure provided herein.

As shown, the control system 100 may generally include a controller 102 configured to electronically control the operation of one or more components of the work vehicle 10, such as the various hydraulic components of the work vehicle 10 (e.g., the lift cylinders 62, the control cylinders 74 and/or the tilt cylinders 64). In general, the controller 102 may comprise any suitable processor-based device known in the art, such as a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as the method 200 described below with reference to FIG. 8. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

In several embodiments, the controller 102 may be configured to be coupled to suitable components for controlling the operation of the various cylinders 62, 64, 74 of the work vehicle 10. For example, as shown in FIG. 7, the controller 102 may be communicatively coupled to suitable valves 108, 110 (e.g., solenoid-activated valves) configured to control the supply of hydraulic fluid to each lift cylinder 62 (only one of which is shown in FIG. 7). Specifically, as shown in the illustrated embodiment, the system 100 may include a first lift valve 108 for regulating the supply of hydraulic fluid to a cap end 112 of each lift cylinder 62. In addition, the system 100 may include a second lift valve 110 for regulating the supply of hydraulic fluid to a rod end 114 of each lift cylinder 62. Moreover, the controller 102 may be communicatively coupled to suitable valves 116, 118 (e.g., solenoid-activated valves) configured to regulate the supply of hydraulic fluid to each control cylinder 74 (only one of which is shown in FIG. 7). For example, as shown in the illustrated embodiment, the system 100 may include a first control valve 116 for regulating the supply of hydraulic fluid to a cap end 120 of each control cylinder 74 and a second control valve 118 for regulating the supply of hydraulic fluid to a rod end 122 of each control cylinder 74. Although not shown, it should be appreciated that the controller 102 may be similarly coupled to suitable valves for controlling the supply of hydraulic fluid to each tilt cylinder 64.

During operation, hydraulic fluid may be transmitted to the PRVs 108, 110, 116, 118 from a fluid tank 124 mounted on and/or within the work vehicle 10 (e.g., via a pump (not shown)). The controller 102 may then be configured to control the operation of each valve 108, 110, 116, 118 in order to control the flow of hydraulic fluid supplied to each of the cylinders 62, 74. For instance, the controller 102 may be configured to transmit suitable control commands to the lift valves 108, 110 in order to regulate the flow of hydraulic fluid supplied to the cap and rod ends 112, 114 of each lift cylinder 62, thereby allowing for control of a stroke length 126, 128 of the piston rod associated with each cylinder 62. Of course, similar control commands may be transmitted from the controller 102 to the control valves 116, 118 in order to control a stroke length 128 of the control cylinders 74. Thus, by carefully controlling the actuation or stroke length 126, 128 of the lift and control cylinders 62, 74, the controller 102 may, in turn, be configured to automatically control the manner in which the loader arms 38, 40 are raised and lowered relative to the vehicle's driving surface 22, thereby allowing the controller 102 to manipulate the travel path of the loader arms 38, 40 as desired.

Additionally, as shown in FIG. 7, the controller 102 may be communicatively coupled to one or more input devices 130 for providing operator inputs to the controller 102. Such input device(s) 130 may generally correspond to any suitable input device(s) (e.g., a control panel, one or more buttons, levers and/or the like) housed within the operator's cab 30 that allows for operator inputs to be provided to the controller 102. For example, in a particular embodiment, the input device(s) 130 may correspond to a lever(s) and/or any other input device(s) that allows for the operator to transmit suitable operator inputs for manually controlling the position of the loader arms 38, 40 and/or implement 12. In response to such input, the controller 102 may transmit suitable control signals to the appropriate valves in order to control the actuation of the corresponding cylinders. Moreover, as will be described in greater detail below, in several embodiments, a plurality of pre-defined travel paths may be stored within the controller's memory 106, such as the travel paths 93, 94, 98, 99 shown in FIGS. 4-6. In such embodiments, the input device(s) 130 may correspond to suitable buttons and/or any other input device(s) that allow for the operator to transmit a suitable operator input(s) corresponding to a selection of one of the pre-defined travel paths. Upon receipt of such input(s), the controller 102 may then transmit suitable control signals to the appropriate valves in order to control the corresponding cylinders in a manner that causes the loader arms 38, 40 to be raised and/or lowered along the selected travel path.

Moreover, as shown in FIG. 7, the controller 102 may be communicatively coupled to one or more position sensors 132 for monitoring the position(s) and/or orientation(s) of the loader arms 38, 40 and/or the control arms 42, 44. In several embodiments, the position sensor(s) 132 may be configured to monitor the degree of actuation of the lift and/or control cylinders 62, 74, which may provide an indication of the position and/or orientation of the corresponding loader arms 38, 40 and/or control arms 42, 44. For instance, the position sensor(s) 132 may correspond to one or more rotary position sensors, linear position sensors and/or the like associated with and/or coupled to the piston rod(s) or other movable components of the cylinders 62, 74 in order to monitor the travel distance of such components. In another embodiment, the position sensor(s) 122 may correspond to one or more non-contact sensors, such as one or more proximity sensors, configured to monitor the change in position of such movable components of the cylinders 62, 74. In a further embodiment, the position sensor(s) may correspond to one or more flow sensors configured to monitor the fluid into and/or out of each cylinder 62, 74, thereby providing an indication of the degree of actuation of such cylinder 62, 74 and, thus, the location of the corresponding loader arms 38, 40 and/or control arms 42, 44.

In other embodiments, the position sensor(s) 132 may correspond to any other suitable sensor(s) that is configured to provide a measurement signal associated with the position and/or orientation of the loader arms 38, 40 and/or control arms 42, 44. For example, a transmitter(s) may be coupled to a portion of one or both of the loader arms 38, 40 and/or one or both of the control arms 42, 44 that transmits a signal indicative of the height/position and/or orientation of such arm(s) 38, 40, 42, 44 to a receiver disposed at another location on the vehicle 10.

By monitoring the position and/or orientation of the loader arms 38, 40 and/or control arms 42, 44 using the measurement signals provided by the sensor(s) 132, the controller 102 may be configured to regulate the operation of the lift and/or control cylinders 62, 74 in a manner that provides for extremely accurate control of the disclosed lift assembly 36. This may be particularly advantageous in instances in which the operator has requested that the loader arms 38, 40 be raised and/or lowered along a selected travel path. For example, upon the receipt of an operator input selecting a given travel path, the controller 102 may verify the exact position of the loader arms 38, 40 and/or control arms 42, 44 using the sensor measurements. Thereafter, the controller 102 may automatically adjust the position of the loader arms 38, 40 and/or control arms 42, 44, if necessary, in order to properly position the loader arms relative to the selected travel path (e.g., by moving the loader arms 38, 40 and/or control arms 42, 44 such that the forward pivot point 50 is positioned on the selected travel path). Moreover, the controller 102 may be configured to continuously monitor the position of the loader arms 38, 40 and/or control arms 42, 44 as the lift and/or control cylinders 62, 74 are being actuated in order to ensure that the actual travel path taken by the loader arms 38, 40 corresponds to the selected travel path.

It should be appreciated that the controller 102 may also be communicatively coupled to any other suitable sensors for monitoring one or more operating parameters of the work vehicle 10. For example, in a particular embodiment, the controller 102 may be coupled to one or more load sensors 134 for monitoring the load weight of any external loads applied through the loader arms 38, 40 via the implement 12. Such load monitoring may assist the controller 102 in determining whether an operator-selected travel path is appropriate given the current loading conditions of the work vehicle 10. For example, if the operator selects a radial travel path for raising the implement 12 to a given height above the driving surface 22, the controller 102 may be configured to utilize the load measurements provided by the sensor(s) 134 to determine whether the operator-selected path or a different travel path should be used to maintain stability of the work vehicle 10. For instance, if the load weight exceeds a given threshold, the controller 102 may determine that a more vertical travel path should be used to raise the implement to the selected height in order to avoid vehicle tipping. In such instance, the controller 102 may be configured to automatically adjust the travel path used for the loader arms 38, 40 to the more appropriate travel path. In addition, or as an alternative thereto, the controller 102 may be configured to provide the operator with a notification (e.g., an audible or visual notification) that the selected travel path is not appropriate given the current operating conditions.

Referring now to FIG. 8, a flow diagram of one embodiment of a method 200 for controlling a lift assembly of a work vehicle is illustrated in accordance with aspects of the present subject matter. In general, the method 200 will be described with reference to the work vehicle 10, lift assembly 36 and system 100 described above with reference to FIGS. 1-8. However, it should be appreciated by those of ordinary skill in the art that the disclosed method 200 may generally be utilized to control any suitable lift assembly included within a work vehicle having any suitable configuration and/or any suitable control system. In addition, although FIG. 8 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 8, at (202), the method 200 includes receiving an operator input associated with a selection of a desired travel path for the loader arms of the work vehicle. For example, as indicated above, one or more pre-defined travel paths may be stored within the controller's memory 106. In such an embodiment, the input device(s) 130 provided within the vehicle's cab 20 may be used to transmit a suitable operator input(s) to the controller 102 that is associated with the selection of one of the pre-defined travel paths.

In addition to such pre-defined travel paths, or as an alternative thereto, one or more customized travel paths may be created and stored within the controller's memory 106. For example, in one embodiment, a control panel of the work vehicle 10 may provide a means (e.g., a display with a suitable operator interface) for allowing an operator to define a customized travel path for the loader arms 38, 40, such as by creating any suitable travel path extending within the bounded travel area 82 associated with the disclosed lift assembly 36. In such an embodiment, the customized travel path may be stored within the controller memory 106 and may be subsequently selected by the operator as the desired travel path to be executed by the controller 102.

Additionally, at (204), the method 200 includes receiving at least one sensor measurement associated with a position of the loader arms and/or the control arms of the work vehicle. For example, as indicated above, the controller 102 may be communicatively coupled to one or more position sensors 132 for monitoring the position of the loader arms 38, 40 and/or the control arms 42, 44. Thus, based on the signals provided by the sensor(s) 132, the controller 132 may be configured to accurately determine the position of the loader arms 38, 40 and/or the control arms 42, 44.

Moreover, at (206), the method 200 includes controlling an actuation of the lift cylinders and/or the control cylinders based on the sensor measurement(s) such that a reference point(s) defined on the loader arms is raised or lowered along the desired travel path selected by the operator. Specifically, as indicated above, the controller 102 may be configured to control the actuation or stroke length 126, 128 of the lift cylinders 38, 40 and/or the control cylinders 40, 42 in order to achieve a plurality of different travel paths within a given travel area 82 associated with the disclosed lift assembly 36. Accordingly, upon receipt of the operator's selection, the controller 102 may control the actuation of the lift cylinders 38, 40 and/or the control cylinders 40, 42 in a manner that causes a given reference point on the loader arms (e.g., the forward pivot point 50) to be raised or lowered along the desired travel path. In doing so, the controller 102 may be configured to utilize the sensor measurements in order to move the reference point to a location on the desired travel path and/or to verify that the reference point is being moved along the desired travel path as it is being raised or lowered.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A lift assembly for a work vehicle, the lift assembly comprising:

a loader arm extending between a forward end and a rear end;

a control arm extending between a first end and a second end, the first end being coupled to a chassis of the work vehicle at a first pivot point and the second end being coupled to the rear end of the loader arm at a second pivot point;

a lift cylinder coupled between the loader arm and the chassis, the lift cylinder being coupled to the loader arm at a location between its forward and rear ends;

a control cylinder extending between an upper end and a lower end, the upper end being coupled to the control arm and the lower end being coupled to the chassis at a third pivot point;

wherein the first pivot point is located rearward of the second pivot point when the control cylinder is at a fully retracted position, wherein the upper end of the control cylinder is coupled to the loader arm at the second pivot point such that the control arm and the control cylinder are both coupled to the loader arm at a common pivot point.

2. The lift assembly of claim 1, wherein a position of the second pivot point is adjusted when the control cylinder is retracted or extended.

3. The lift assembly of claim 1, wherein the control cylinder is configured to be maintained at the fully retracted position or extended from the fully retracted position when the loader arm is initially raised from a lowermost position.

4. The lift assembly of claim 1, wherein the lift cylinder is coupled to the chassis at a fourth pivot point, the fourth pivot point being positioned at a location vertically below and rearward of the third pivot point.

5. The lift assembly of claim 1, wherein the third pivot point is located vertically above and forward of the first pivot point.

6. The lift assembly of claim 1, further comprising a controller communicatively coupled to the lift cylinder and the control cylinder, the controller being configured to control an actuation of at least one the lift cylinder or the control cylinder such that a reference point defined on the loader arm is moved along a travel path defined within a travel area associated with the lift assembly.

7. The lift assembly of claim 6, further comprising at least one position sensor communicatively coupled to the controller for monitoring a position of at least one of the loader arm or the control arm, the controller being configured to control the actuation of the at least one the lift cylinder or the control cylinder based on signals received from the at least one position sensor such that the reference point is moved along the travel path.

8. A lift assembly for a work vehicle, the lift assembly comprising:

a loader arm extending between a forward end and a rear end;

a control arm extending between a first end and a second end, the first end being coupled to a chassis of the work vehicle at a first pivot point and the second end being coupled to the rear end of the loader arm at a second pivot point;

a lift cylinder coupled between the loader arm and the chassis, the lift cylinder being coupled to the loader arm at a location between its forward and rear ends;

a control cylinder extending between an upper end and a lower end, the upper end being coupled to the control arm and the lower end being coupled to the chassis at a third pivot point;

wherein the lift cylinder is coupled to the chassis at a fourth pivot point that is positioned both vertically below and rearward of the third pivot point; and wherein the control cylinder is configured to either be maintained at a fully retraced position or extended outwardly from the fully retracted position as the loader arm is initially being raised from a lowermost position.

9. The lift assembly of claim 8, wherein the first pivot point is located rearward of and vertically below the second pivot point when the control cylinder is at a fully retracted position such that the control arm extends both vertically upward and forward from its first end to its second end when the control cylinder is at the fully retracted position.

10. The lift assembly of claim 8, wherein the upper end of the control cylinder is coupled to the control arm at the second pivot point.

11. The lift assembly of claim 8, wherein the third pivot point is located vertically above and forward of the first pivot point.

12. The lift assembly of claim 8, further comprising a controller communicatively coupled to the lift cylinder and the control cylinder, the controller being configured to control an actuation of at least one the lift cylinder or the control cylinder such that a reference point defined on the loader arm is moved along a travel path defined within a travel area associated with the lift assembly.

13. The lift assembly of claim 12, further comprising at least one position sensor communicatively coupled to the controller for monitoring a position of at least one of the loader arm or the control arm, the controller being configured to control the actuation of the at least one the lift cylinder or the control cylinder based on signals received from the at least one position sensor such that the reference point is moved along the travel path.

14. A method for controlling a lift assembly of a work vehicle, the lift assembly including a loader arm and a control arm, the control arm extending between a first end coupled to a chassis of the work vehicle at a first pivot point and a second end coupled to the loader arm at a second pivot point, receiving, with a computing device, an operator input associated with a selection of a desired travel path for the loader arm;

receiving, with the computing device, at least one sensor measurement associated with a position of at least one of the loader arm or the control arm;

controlling, with the computing device, an actuation of at least one of a lift cylinder or a control cylinder based on the at least one sensor measurement such that a reference point defined on the loader arm is raised or lowered along the desired travel path, the lift cylinder being coupled between the loader arm and the chassis, the control cylinder extending between an upper end coupled to the control arm and a lower end coupled to the chassis at a third pivot point; and wherein the upper end of the control cylinder is coupled to the loader arm at the second pivot point such that the control arm and the control cylinder are both coupled to the loader arm at a common pivot point.

15. The method of claim 14, wherein controlling the actuation of the at least one the lift cylinder or the control cylinder based on the at least one sensor measurement comprises controlling the actuation of the control cylinder such that the control cylinder is maintained at a fully retracted position or is extended from the fully retracted position when the loader arm is initially raised from a lowermost position.

16. The method of claim 14, wherein the desired travel path corresponds to a straight vertical path.

17. The method of claim 14, wherein controlling the actuation of the at least one the lift cylinder or the control cylinder based on the at least one sensor measurement comprises controlling the actuation of the at least one the lift cylinder or the control cylinder such that a location of second pivot point is pivoted about the first pivot point.

* * * * *